United States Patent [19]

Ofuji

[11] 4,389,939

[45] Jun. 28, 1983

[54] SHOTGUN CARTRIDGE

[76] Inventor: Hiroshi Ofuji, 21-14, Togoshi 6-chome, Shinagawa-ku, Tokyo, Japan

[21] Appl. No.: 181,236

[22] Filed: Aug. 25, 1980

[30] Foreign Application Priority Data

Mar. 28, 1980 [JP] Japan ..... 55-40160[U]

[51] Int. Cl.[3] ..... F42B 7/02

[52] U.S. Cl. ..... 102/458; 102/513

[58] Field of Search ..... 102/458, 334, 364, 513, 102/204, 205, 448, 449

[56] References Cited

U.S. PATENT DOCUMENTS

| | | | |
|---|---|---|---|
| 1,304,962 | 5/1919 | Gravely | 102/458 |
| 1,887,989 | 11/1932 | Brownsdon et al. | 102/458 |
| 1,887,990 | 11/1932 | Brownsdon et al. | 102/458 |
| 1,951,794 | 3/1934 | Jackson et al. | 102/458 |
| 3,405,638 | 10/1968 | Stoner, Jr. | 102/458 X |
| 3,717,097 | 2/1973 | Wronka et al. | 102/334 |

OTHER PUBLICATIONS

"Explosives", Verlag Chemie by Rudolf Meyer, 1977, p. 229.

*Primary Examiner*—Harold J. Tudor

*Attorney, Agent, or Firm*—Spencer & Kaye

[57] ABSTRACT

A shotgun cartridge comprising a charge of shot, each shot being coated with an illuminant, and a solid firing agent for firing the illuminant, so that upon firing the cartridge a marksman can trace the trajectories of the individual shots and the extent to which the charge of shot spreads.

6 Claims, 7 Drawing Figures

SHOTGUN CARTRIDGE

BACKGROUND OF THE INVENTION

1. Field of the Invention

This invention relates to a shotgun cartridge, and more particularly to a tracer or similar cartridge which facilitates tracing of the trajectories of individual shots propelled from a shotgun. The cartridge of the invention is suitable for shooting or hunting and allows a marksman to trace the manner in which the propelled shots spread out.

2. Description of the Prior Art

In rifle shooting, a single bullet is fired at a fixed target. Clay-pigeon shooting, on the other hand, which includes trapshooting and skeet shooting is different from rifle shooting in that the object of clay-pigeon shooting is to hit a flying target (i.e., a clay-pigeon in the form of an ash-tray like saucer made of pitch and clay or limestone which measure 11 centimeters in diameter and 100 grams in weight) flying at 20 meters per second. A cartridge for clay-pigeon shooting (powder-loaded shot cartridge) includes hundreds of small lead shots, and when the cartridge is fired, the shots are propelled and spread out a certain extent so that some of the shots may hit the clay-pigeon and break it. The marksman who hits the most clay-pigeons wins the clay-pigeon shooting competition.

Since the clay-pigeon flies fairly quickly, one cannot score a hit by directly aiming at the clay-pigeon itself, but must fire the charge of shots ahead of (i.e., the so-called "lead") the flying clay-pigeon to allow for the movement of the target. The secret and the interest of clay-pigeon shooting is partly in this lead, and the magnitude of the lead varies considerably from marksman to marksman depending on the state of their reflex and motor nerves. Each beginner in clay-pigeon shooting has to expend much effort and money to get his best feeling for producing the proper lead, because in the beginning he is hardly aware of whether he has fired ahead of the flying clay-pigeon or not. Accordingly, the clay-pigeon shooting coach finds it most difficult to teach beginners how to obtain a proper lead.

If the shots fired emanate visual traces while flying so as to enable a marksman to see clearly the way his shots fly, the marksman can easily find out the relative positions of the flying clay-pigeon and his shots flying with a certain extent of spread, and such visual traces will greatly facilitate the practice or exercise of clay-pigeon shooting beginners. Heretofore, tracer cartridges have been used for practice. The tracer cartridge of the prior art, however, uses one tracer capsule per cartridge, so that the marksman can see the trajectory of the tracer capsule but he cannot see the extent to which the shots he fired spread. Thus, there is a need for a tracer cartridge which produces traces of the individual shots from the cartridge.

SUMMARY OF THE INVENTION

Therefore, an object of the present invention is to provide an improved shotgun cartridge which meets the aforementioned need for seeing the spread of shots to facilitate the practice of clay-pigeon shooting.

Another object of the present invention is to provide a safe shotgun cartridge which produces visual traces of the individual shots from the cartridge, the duration of said visual traces being long enough to permit tracing the trajectories of the shots but not exceeding the flying time of the shots.

To fulfil the aforementioned objects, a shotgun cartridge according to the present invention comprises a shell having a powder space and a shot space, powder placed in the powder space, shots placed in the shot space, at least one of wads and plugs disposed in the shell so as to partition the shots from the powder, a through hole communicating the powder space with the shot space across at least one of the wads and plugs, and a solid firing agent disposed in the shots so as to face the through hole, each of the shots being coated with a visible identifying agent.

BRIEF DESCRIPTION OF THE DRAWING

For a better understanding of the invention, reference is made to the accompanying drawing, in which.

Like parts are designated by like numerals and symbols throughout different views of the drawing.

DESCRIPTION OF THE PREFERRED EMBODIMENTS

Figure 1A:
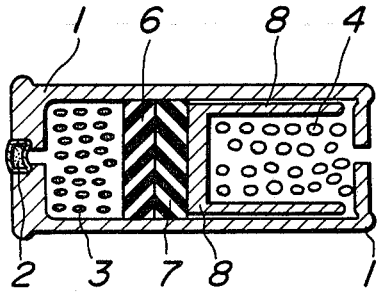
FIG. 1A PRIOR ART
FIG. 1A is a schematic sectional view of a conventional shotgun cartridge for clay-pigeon shooting.

Before describing the details of the present invention, the construction of a shotgun cartridge of the prior art will be briefly reviewed. Referring to FIG. 1A, a typical conventional shotgun cartridge for clay-pigeon shooting has a shell 1 with a primer 2 mounted thereon, gun powder 3 preferably consisting of smokeless powder and shots 4. At least one of wads 5 (FIG. 1B) and plugs 6 and 7 are disposed between the powder 3 and the shots 4. The shots 4 are generally placed in a shot cup 8.

Figure 1B:
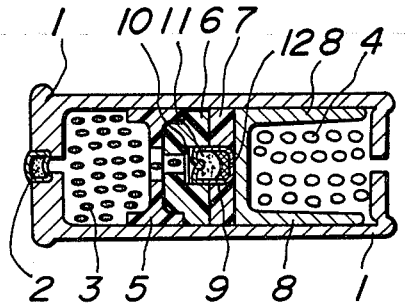
FIG. 1B PRIOR ART
FIG. 1B is a schematic sectional view of a conventional tracer cartridge for clay-pigeon shooting.

Referring to FIG. 1B, a conventional tracer cartridge for clay-pigeon shooting has a tracer capsule 9 which is typically embedded in the plugs 6 and 7 between the powder 3 and shots 4. Starting from the side of the powder 3, the tracer capsule 9 houses a firing agent 10, an illuminant 11, and a weight 12 (made of lead) fitted at the bottom of the tracer capsule or at that end of the tracer capsule which is on the side of the flying direction thereof. In the case of the tracer cartridge of FIG. 1B, as the powder 3 is fired by the impact of the primer 2, the firing agent 10 at the tracer capsule 9 is simultaneously ignited for burning the illuminant 11, and at the same time both the shots 4 and the tracer capsule 9 are propelled. Thus, the tracer capsule 9 flies while showing a visual trace thereof to the marksman. The visual trace of the capsule 9 is, however, limited to that of one capsule alone. The flying direction of the one capsule is considerably different from the flying manner of hundreds of the shots 4 in that the shots 4 have a certain extent of spread and fly as a group with that extent of spread. In practice, it has been impossible to see the extent of spread of the shots 4 even if the tracer cartridge with the tracer capsule 9 is used.

Figure 2A:
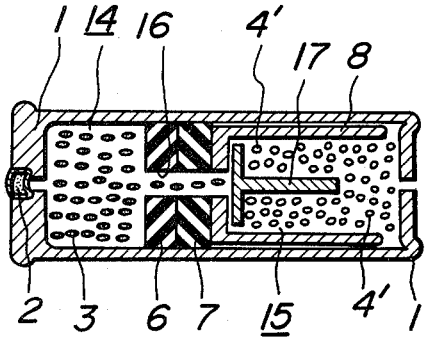
FIGS. 2A and 2B are schematic sectional views of different embodiment of a shotgun cartridge according to the present invention.
Figure 2B:
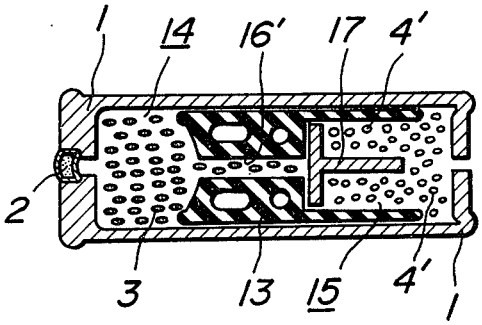

The shotgun cartridge according to the present invention will now be described by referring to FIGS. 2A and 2B. In the embodiment of FIG. 2A, powder 3 and shots 4' disposed in a shell 1 are separated by plugs 6 and 7 and a shot cup 8. FIG. 2B shows another embodiment of the invention which uses a plastic wad 13 as an integral member acting both as plugs and as a shot cup to separate the shots 4' from the powder 3. In the cartridge of the present invention, a powder-loading space 14 for the powder 3 communicates with a shot-loading space 15 for the shots 4'. More particularly, a through hole 16 or 16' is bored in the plugs 6 and 7 or in the plastic wad 13, so that the burning flame of the powder 3 directly propagates to the shot-loading space 15.

Figure 3A:
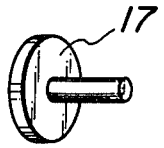
FIG. 3 illustrates schematic perspective views of differently shaped solid firing agents.
Figure 3B:
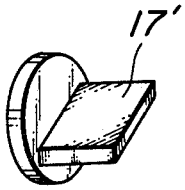
Figure 3C:
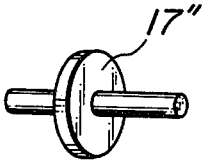

In the shot-loading space 15 of the aforementioned cartridge of the present invention, a solid firing agent 17 is disposed so as to face the aforementioned through hole 16 or 16'. FIG. 3(*a*) shows a schematic perspective view of the solid firing agent 17, and FIGS. 3(*b*) and 3(*c*) show similar views of differently shaped solid firing agents 17' and 17'', respectively. With the disposition of FIG. 2A or 2B, the propagation of the burning flame of the powder 3 immediately reaches the solid firing agent 17 to ignite the agent 17. The illustrated preferable shape of the solid firing agent 17 is so selected as to reliably and uniformly ignite the illuminant and other coatings of the individual shots 4', as will be described hereinafter.

As compared with the conventional capsule type tracer, the structure of the shotgun cartridge of the present invention is characterized in that each of the shots 4' is coated with a layer of a visible identifying agent 18. The visible identifying agent may contain a tracing agent (i.e., a flame-coloring agent such as strontium carbonate $SrCO_3$, barium nitrate $Ba(NO_3)_2$, or sodium oxalate $Na_2C_2O_4$ plus an oxidizing agent plus an auxiliary firing agent plus a binder); and/or a smoking agent (i.e., a smoking agent such as smoke red, methylene blue, plus an oxidizing agent plus an auxiliary firing agent plus a binder). Accordingly, when the flying shots 4' spread out to a certain extent, the extent of the spread is visualized by the marksman who sees the burning traces of the individual shots 4', so that the marksman can see the exact trajectories and the extent of the spread of the individual shots 4'.

Figure 4A:
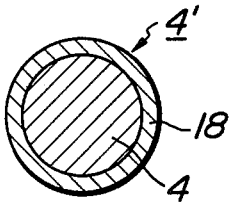
FIGS. 4A and 4B are sectional views of shots to be used in the shotgun cartridge of the present invention.
Figure 4B:
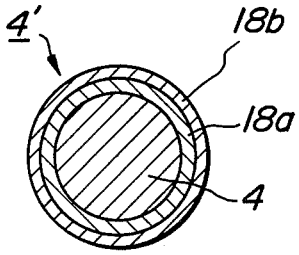

It is noted here that the tracing agent must generate sufficient brightness to ensure visual recognition of the shot trajectories even in the daytime. The color of the illuminant may be redish, such as pink or orange, or greenish, but the present invention is not restricted to redish or greenish illuminants. The amount of the visible identifying agent to be coated on each shot should be such that, in the case of the cartridge for trapshooting, the coating burns out before the shots fly over about 50 meters from the shotgun, and in the case of the cartridge for skeet shooting, the coating burns out before the shots fly over about 25 meters from the shotgun. The aforementioned amount of the coating for each shot is selected because clay-pigeons are generally hit within a range of less than about 50 meters in the case of trapshooting, and within a range of less than about 25 meters in the case of skeet shooting. An excessive amount of the coating of the visible identifying agent is not desirable because if the excessive visible identifying agent continues to burn after the shots reach the ground, the burning visible identifying agent may fire dry grass on the embankment of the shooting field. The visible identifying agent is coated on each shot either in one layer, as shown by numeral 18 in FIG. 4A, or in two layers, as shown by symbols 18*a* and 18*b* in FIG. 4B.

As described in the foregoing, with the tracer cartridge for a shotgun according to the present invention, the group of shots propelled from the cartridge emanate visible traces while flying, so that a marksman can accurately see the direction and the spreading extent of the flying shots. Accordingly, practicing firing the shotgun at a flying target with a proper lead is greatly facilitated. As a result, the shotgun cartridge of the present invention contributes greatly to the improvement of the skill of the clay-pigeon shooting marksman, and especially assists the practice or exercise of the clay-pigeon shooting beginner. Thus, the practical value of the shotgun cartridge of the present invention is very high.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A shotgun cartridge comprising a hollow cylindrical shell having first and second ends and a longitudinal axis;

a charge of shot;

a plastic wad located intermediate the first and second ends of said shell, said plastic wad having an opening therein extending along said longitudinal axis and including a shot cup projecting from one end thereof, the other end of said plastic wad forming a first space between the first end of said shell and said wad for receiving gun powder, said shot cup and the second end of said shell defining a second space for receiving said charge of shot, said opening connecting said first space with said second space;

an identifying agent coating each shot in said charge, said identifying agent being ignitable to produce a visible trace; and a solid firing device consisting solely of a combustible material located entirely within said second space, said solid firing device comprising a disc portion having first and second parallel surfaces with diameters greater than that of said opening and a projection having one of a cylindrical and rectangular shape extending from the first surface of said disc portion into said second space, the second surface of said disc facing the opening in said plastic wad and the projection of said solid firing device and the first surface of said disc being in physical contact with at least some of said shot, the igniting of said powder causing a flame to propagate through the opening in said plastic wad to ignite said firing device which in turn ignites the identifying agent coating said shot, the spread of said shot after ejection from said shell thereby being made visible by the burning of said identifying agent.

2. A shotgun cartridge as set forth in claim 1, wherein each of said shot is coated with one layer of said identifying agent.

3. A shotgun cartridge as set forth in claim 1, wherein each of said shot is coated with two layers of said identifying agent.

4. A shotgun cartridge as set forth in claim 1, wherein said identifying agent includes a flame-coloring agent selected from the group consisting of strontium carbonate, barium nitrate, and sodium oxalate, an oxidizing agent, an auxiliary firing agent, and a binder.

5. A shotgun cartridge as set forth in claim 1, wherein said identifying agent includes a smoking agent selected from the group consisting of smoke red, methylene blue, and an oxidizing agent, an auxiliary firing agent, and a solidifying agent.

6. A shotgun cartridge as set forth in claim 1 wherein the projection extending from the first surface of said disc portion is cylindrical and wherein a further cylindrical projection extends from the second surface of said disc.

* * * * *